US009359851B2

(12) United States Patent
Coppedge et al.

(10) Patent No.: US 9,359,851 B2
(45) Date of Patent: Jun. 7, 2016

(54) HIGH ENERGY TUBULAR SHEAR

(71) Applicant: BASTION TECHNOLOGIES, INC., Houston, TX (US)

(72) Inventors: Charles Don Coppedge, Houston, TX (US); Shyang Wen Tseng, Houston, TX (US); George O. Fabela, Houston, TX (US)

(73) Assignee: Bastion Technologies, Inc., Houston, TX (US)

( * ) Notice: Subject to any disclaimer, the term of this patent is extended or adjusted under 35 U.S.C. 154(b) by 126 days.

(21) Appl. No.: 13/776,364

(22) Filed: Feb. 25, 2013

(65) Prior Publication Data

US 2013/0220627 A1 Aug. 29, 2013

Related U.S. Application Data

(60) Provisional application No. 61/602,291, filed on Feb. 23, 2012.

(51) Int. Cl.

| | |
|---|---|
| ***F16K 31/122*** | (2006.01) |
| ***F15B 13/04*** | (2006.01) |
| ***E21B 7/12*** | (2006.01) |
| ***E21B 33/06*** | (2006.01) |
| ***E21B 33/038*** | (2006.01) |

(52) U.S. Cl.

CPC ..... *E21B 33/038* (2013.01); *E21B 33/063* (2013.01)

(58) Field of Classification Search

None

See application file for complete search history.

(56) References Cited

U.S. PATENT DOCUMENTS

| | | | | | |
|---|---|---|---|---|---|
| 4,046,191 | A * | 9/1977 | Neath | E21B 21/001 | 166/352 |
| 4,864,914 | A * | 9/1989 | LeMoine | F15B 3/00 | 251/1.3 |
| 5,505,426 | A * | 4/1996 | Whitby | E21B 33/063 | 251/1.1 |
| 5,653,418 | A * | 8/1997 | Olson | E21B 29/08 | 251/1.3 |
| 5,676,209 | A * | 10/1997 | Reynolds | 166/345 | |
| 6,089,526 | A * | 7/2000 | Olson | E21B 33/062 | 251/1.1 |
| 6,244,560 | B1 * | 6/2001 | Johnson | 251/1.3 | |
| 2011/0284237 | A1 * | 11/2011 | Baugh | 166/365 | |
| 2012/0048566 | A1 | 3/2012 | Coppedge | | |

* cited by examiner

*Primary Examiner* — Matthew R Buck
*Assistant Examiner* — Douglas S Wood
(74) *Attorney, Agent, or Firm* — Winstead PC

(57) ABSTRACT

A high energy tubular shear is connectable within a drilling system and includes a body forming a bore through which a tubular is disposed, a cross-bore intersecting the bore, opposing cutters moveably positioned in the cross-bore on opposite sides of the bore, and the each cutter in hydraulic communication with a respective hydraulic intensifier.

19 Claims, 8 Drawing Sheets

HIGH ENERGY TUBULAR SHEAR

SUMMARY

According to one more embodiments, a high energy tubular shear is connectable within a drilling system and includes a body forming a bore through which a tubular is disposed, a cross-bore intersecting the bore, opposing cutters moveably positioned in the cross-bore on opposite sides of the bore, and the each cutter in hydraulic communication with a respective hydraulic intensifiers. Each cutter may be hydraulically connected to a respective two or more hydraulic intensifier. According to at least one embodiment, each cutter is disposed on a ram having a piston and a retraction chamber is formed in the body between the piston and the cutter. According to one or more embodiments, a dual-mode chamber disposed between a high pressure end of the hydraulic intensifier and the piston of the cutter. The cutters may be positioned between laterally spaced apart opposing backing plates that are located in the cross-bore and extend across the bore.

A subsea well system according to one or more embodiments includes a safing assembly connector interconnecting a lower safing assembly to an upper safing assembly, the lower safing assembly connected to a blowout preventer stack on a subsea well and the upper safing assembly connected to a marine riser; the lower safing assembly has lower slips to engage a tubular suspended in a bore formed through the lower and the upper safing assemblies; the upper safing assembly has upper slips operable to engage the tubular; and a high energy tubular shear positioned between the upper slips and the lower slips, the high energy tubular shear operable to shear the tubular, wherein the high energy tubular shear includes a body forming the bore through which the tubular is disposed, a cross-bore intersecting the bore, opposing cutters moveably positioned in the cross-bore on opposite sides of the bore; and the each cutter in hydraulic communication with a respective hydraulic intensifier.

The foregoing has outlined some features and technical advantages in order that the detailed description of the high energy tubular shear that follows may be better understood. Additional features and advantages of the high energy tubular shear will be described hereinafter which form the subject of the claims of the invention. This summary is not intended to identify key or essential features of the claimed subject matter, nor is it intended to be used as an aid in limiting the scope of the claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
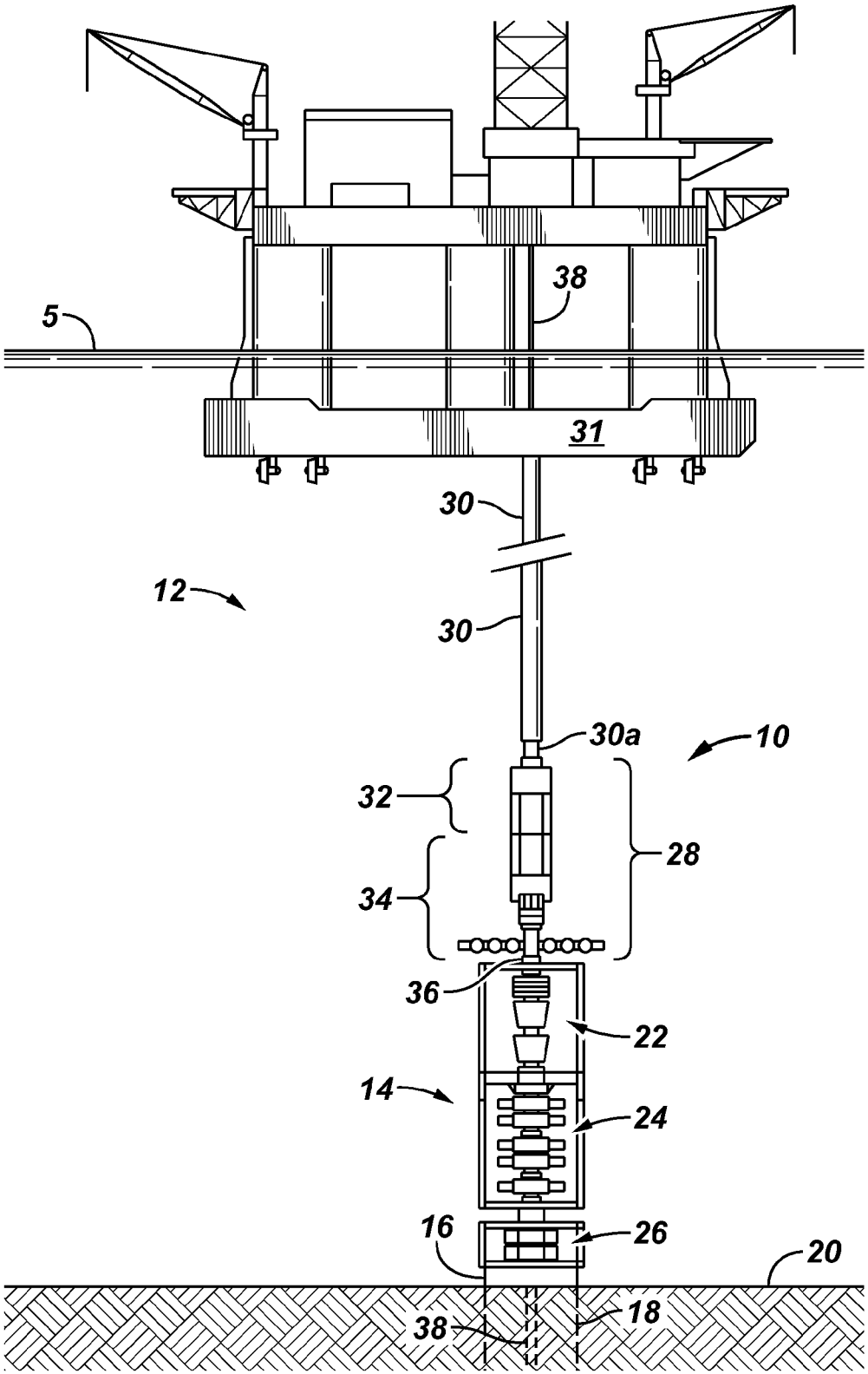
FIGS. 1 and 2 illustrate a subsea safety system according to an embodiment incorporating the high energy tubular shear.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In this disclosure, "hydraulically coupled" or "hydraulically connected" and similar terms, may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled may include certain arrangements where fluid may not flow between the items, but the fluid pressure may nonetheless be transmitted.

FIG. 1 is a schematic illustration of a subsea well safing system, generally denoted by the numeral 10, being utilized in a subsea well drilling system 12. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 also includes subsea test valves ("SSTV") 26. As will be understood by those skilled in the art with benefit of this disclosure, BOP stack 14 is not limited to the devices depicted.

Figure 2:
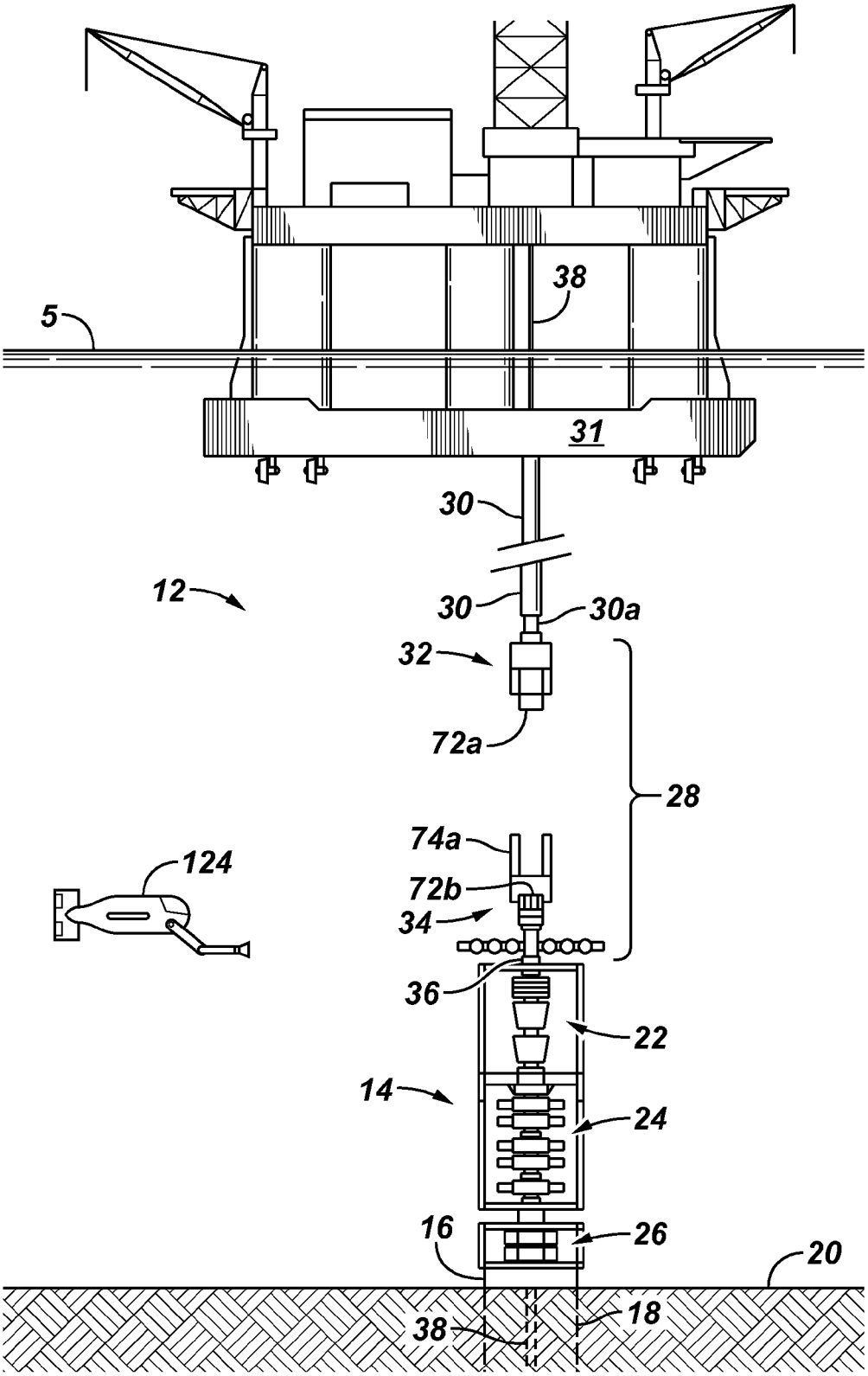

Subsea well safing system 10 comprises safing package, or assembly, referred to herein as a catastrophic safing package ("CSP") 28 that is landed on BOP system 14 and operationally connects a riser 30 extending from platform 31 (e.g., vessel, rig, ship, etc.) to BOP stack 14 and thus well 18. CSP 28 comprises an upper CSP 32 and a lower CSP 34 that are adapted to separate from one another in response to initiation of a safing sequence thereby disconnecting riser 30 from the BOP stack 14 and well 18, for example as illustrated in FIG. 2. The safing sequence is initiated in response to parameters indicating the occurrence of a failure in well 18 with the potential of leading to a blowout of the well. According to one or more embodiments, subsea well safing system 10 may automatically initiate the safing sequence in response to the correspondence of monitored parameters to selected safing triggers.

LMRP 22 and BOP stack 14 are coupled together by a wellbore connector that is engaged with a corresponding mandrel on the upper end of BOP stack 14. LMRP 22 typically provides the interface (i.e., connection) of the BOPs 24 and the bottom end 30*a* of marine riser 30 via a riser connector 36 (i.e., riser adapter). Riser connector 36 commonly comprises a riser adapter for connecting the lowest end 30*a* of riser 30 (e.g., bolts, welding, hydraulic connector) and a flex joint that provides for a range of angular movement of riser 30 (e.g., 10 degrees) relative to BOP stack 14, for example to compensate for vessel 31 offset and current effects on along the length of riser 30. Riser connector 36 may further comprise one or more ports for connecting fluid (i.e., hydraulic) and electrical conductors, i.e., communication umbilical, which may extend along riser 30 from the drilling platform located at surface 5 to subsea drilling system 12. For example, it is common for a hydraulic choke line 44 and a hydraulic kill line 46 to extend from the surface for connection to BOP stack 14.

Riser 30 is a tubular string that extends from the drilling platform 31 down to well 18. The riser is in effect an extension of the wellbore extending through the water column to drilling vessel 31. The riser diameter is large enough to allow for drillpipe, casing strings, logging tools and the like to pass through. For example, in FIGS. 1 and 2, a tubular 38 (e.g., drillpipe) is illustrated deployed from drilling platform 31 into riser 30. Drilling mud and drill cuttings can be returned to surface 5 through riser 30. Communication umbilical (e.g., hydraulic, electric, optic, etc.) can be deployed exterior to or through riser 30 to CSP 28 and BOP stack 14. A remote operated vehicle ("ROV") 124 is depicted in FIG. 2 and may be utilized for various tasks.

Figure 3:
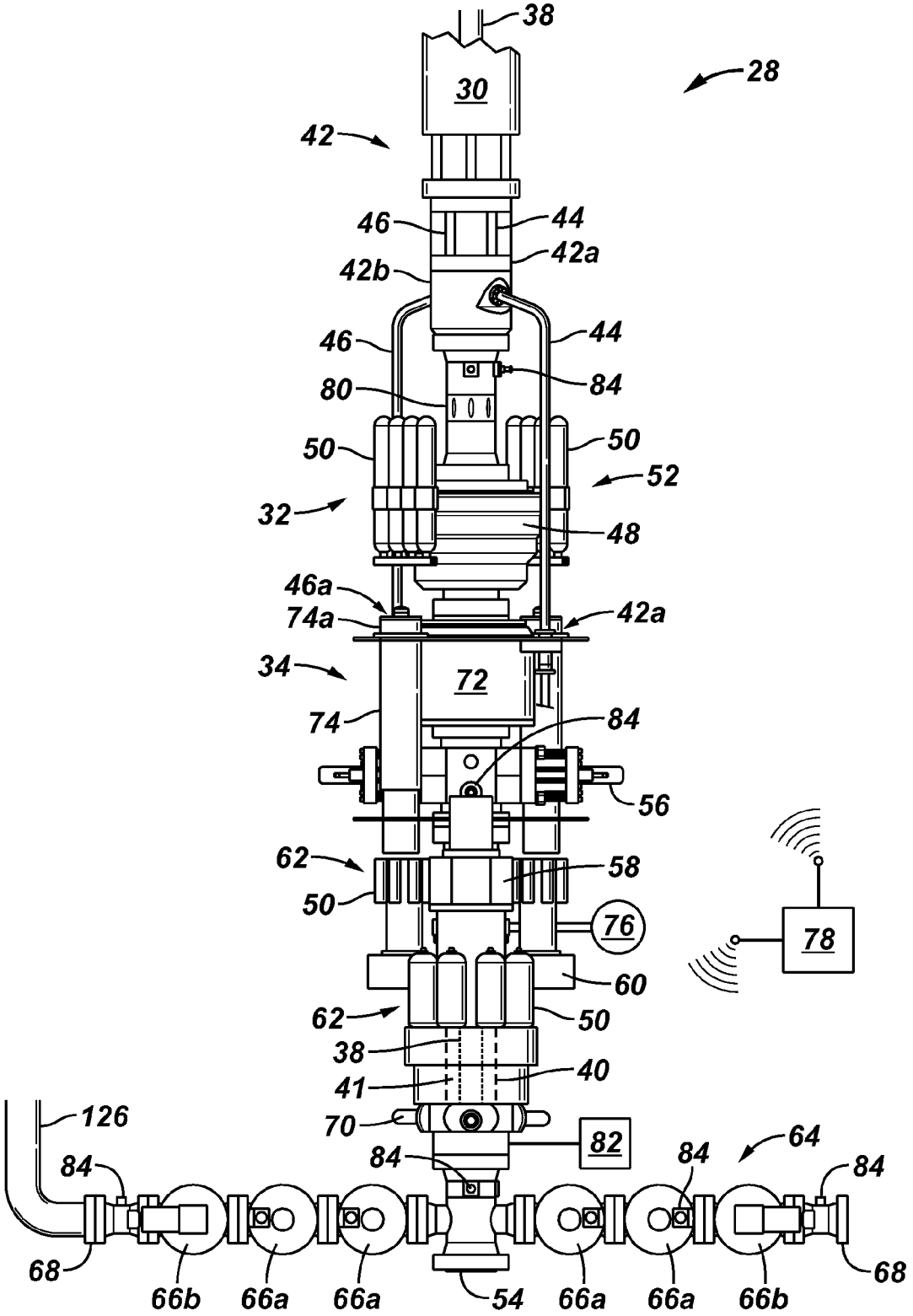
FIG. 3 illustrates a high energy tubular shear installed in subsea well safing assembly according to one or more embodiments.

Refer now to FIG. 3 which illustrates a subsea well safing package 28 according to one or more embodiments in isolation. CSP 28 depicted in FIG. 3 is further described with reference to FIGS. 1 and 2. In the depicted embodiment, CSP 28 comprises upper CSP 32 and lower CSP 34. Upper CSP 32 comprises a riser connector 42 which may include a riser flange connection 42*a*, and a riser adapter 42*b* which may provide for connection of communication umbilicals and extension of the communication umbilicals to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14.

CSP 28 comprises an internal longitudinal bore 40, depicted in FIG. 3 by the dashed line through lower CSP 34, for passing tubular 38. Annulus 41 is formed between the outside diameter of tubular 38 and the diameter of bore 40.

Upper CSP 32 further comprises a slips 48 (i.e., safety slips) adapted to close on tubular 38. Slips 48 are actuated in the depicted embodiment by hydraulic pressure from an accumulator 50. In the depicted embodiment, CSP 28 comprises a plurality of hydraulic accumulators 50 which may be interconnected in pods, such as upper accumulator pod 52.

Lower CSP 34 comprises a connector 54 to connect to BOP stack 14, for example, via riser connector 36, rams 56 (e.g., blind rams), high energy tubular shear 58, lower slips 60 (e.g., bi-directional slips), and a vent system 64 (e.g., valve manifold). Vent system 64 comprises one or more valves 66. In this embodiment, vent system 64 comprise vent valves (e.g., ball valves) 66*a*, choke valves 66*b*, and one or more connection mandrels 68. Valves 66*b* can be utilized to control fluid flow through connection mandrels 68. For example, a recovery riser 126 is depicted connected to one of mandrels 68 for flowing effluent from the well and/or circulating a kill fluid (e.g., drilling mud) into the well as further described below.

In the depicted embodiment, lower CPS 34 further comprises a deflector device 70 (e.g., impingement device, shutter ram) disposed above vent system 64 and below lower slips 60, high energy shear 58, and blind rams 56. Lower CSP 34 includes a plurality of hydraulic accumulators 50 that are arranged and connected in one or more lower hydraulic pods 62 for operations of various devices of CSP 28. As will be further described below, CSP 28, in particular lower CSP 34, may include methanol, or other chemical, source 76 operationally connected for injecting into lower CSP 34, for example to prevent hydrate formation.

Upper CSP 32 and lower CSP 34 are detachably connected to one another by a connector 72. An ejector device 74 (e.g., ejector bollards) are operationally connected between upper CSP 32 and lower CSP 34 to separate upper CSP 32 and riser 30 from lower CSP 34 and BOP stack 14 after connector 72 has been actuated to the unlocked position. CSP 28 also includes a plurality of sensors 84 which can sense various parameters, such as and without limitation, temperature, pressure, strain (tensile, compression, torque), vibration, and fluid flow rate. Sensors 84 further includes, without limitation, erosion sensors, position sensors, and accelerometers and the like. Sensors 84 can be in communication with one or more control and monitoring systems, for example as further described below, forming a limit state sensor package.

CSP 28 has a control system 78 which may be located subsea, for example at CSP 28 or at a remote location such as at the surface. Control system 78 may comprise one or more controllers which are located at different locations. For example, in at least one embodiment, control system 78 comprise an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices and to surface (i.e., drilling platform 31) control systems. Each of upper and lower controllers 80, 82 may comprise a collection of real-time computer circuitry, field programmable gate arrays (FPGA), I/O modules, power circuitry, power storage circuitry, software, and communications circuitry. One or both of upper and lower controller 80, 82 may comprise control valves.

According to at least one embodiment, one of the controllers, for example lower controller 82, serves as the primary controller and provides command and control sequencing to various subsystems of safing package 28 and/or communicates commands from a regulatory authority for example located at the surface. Upper controller 80 is described herein as operationally connected with a plurality of sensors 84 positioned throughout CSP 28 and may include sensors connected to other portions of the drilling system, including along riser 30, at wellhead 16, and in well 18. Upper controller 80, using data communicated from sensors 84, continuously monitors limit state conditions of drilling system 12. If a defined limit state is exceeded an activation signal (e.g., alarm) can be transmitted to the surface and/or lower controller 82. A safing sequence may be initiated automatically by control system 78 and/or manually in response to the activation signal.

Figure 4A:
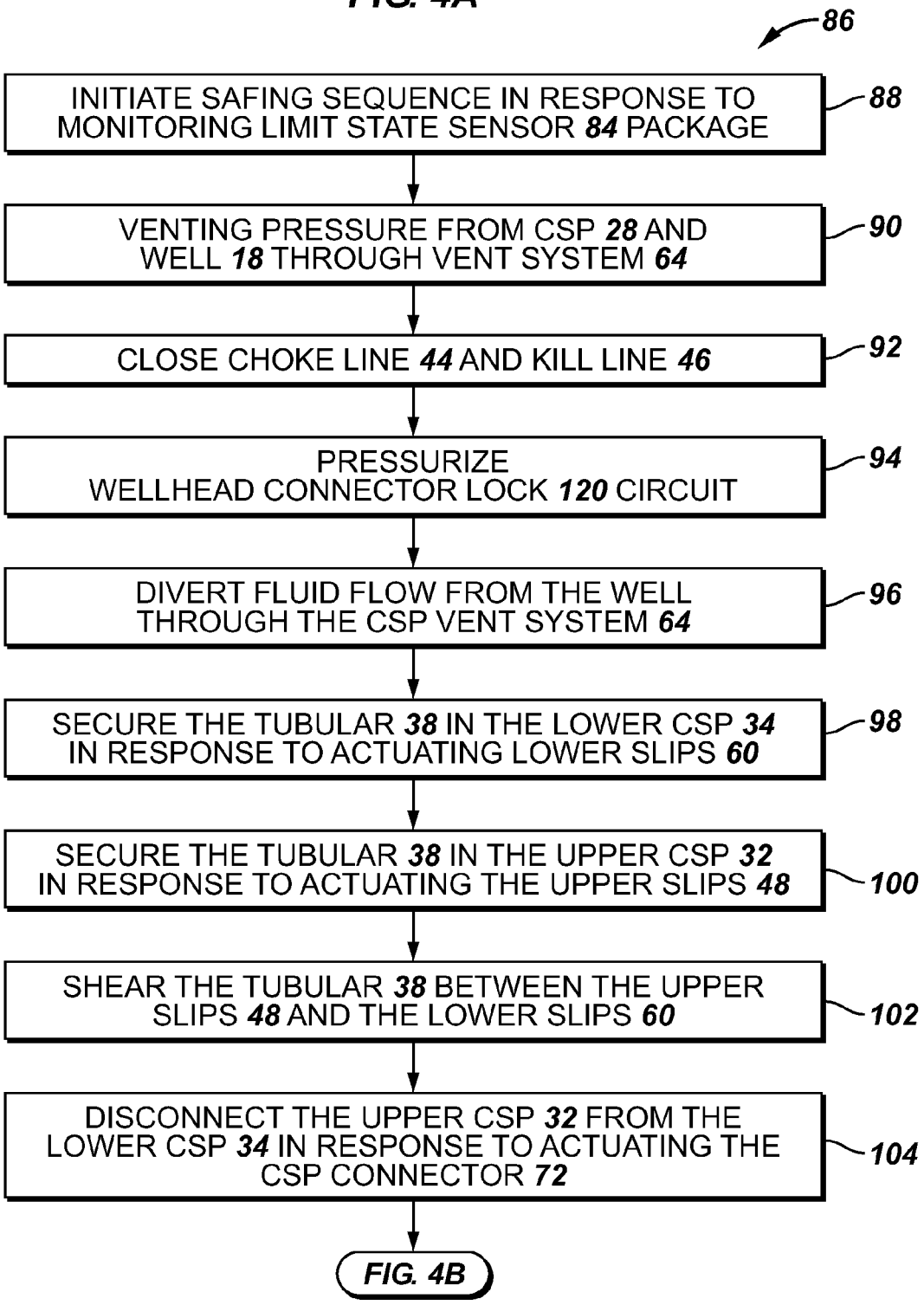
FIG. 4A-4B is a flow chart of a subsea well safing sequence according to one or more embodiments.
Figure 4B:
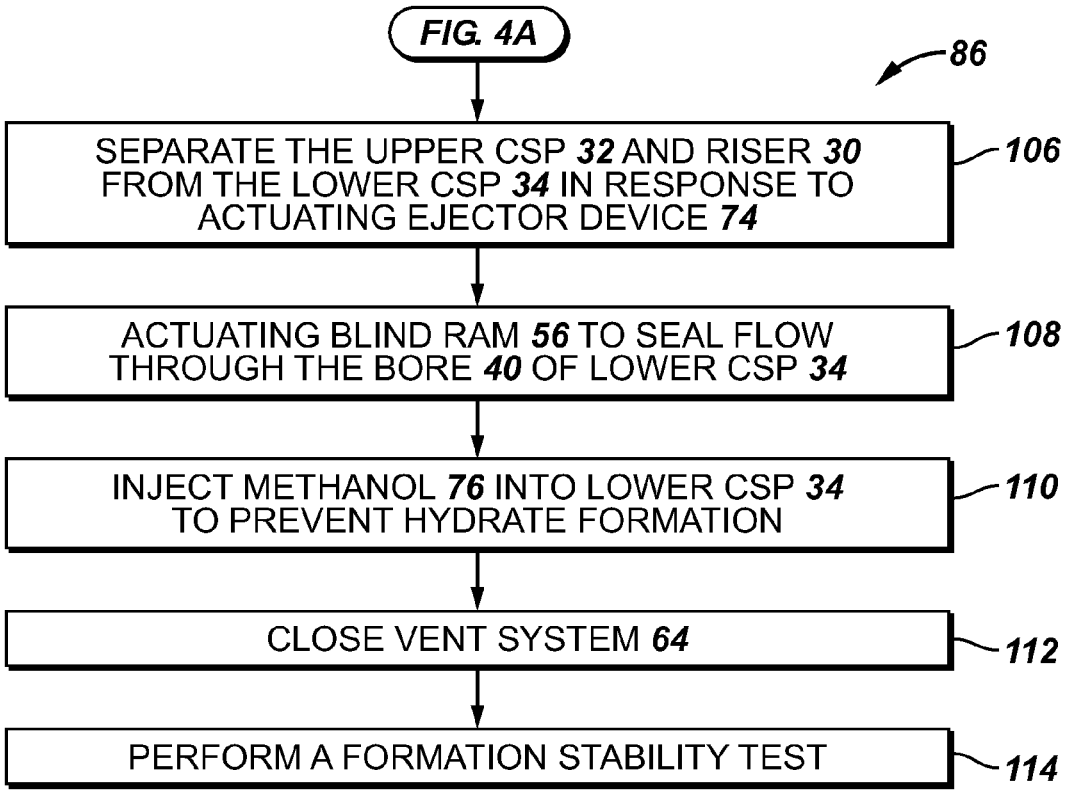

With reference to FIGS. 4A and 4B, a safing sequence 86 according to one or more embodiments of subsea well safing system 10 is disclosed. In sequence step 88, the safing sequence is initiated in response to monitoring the limit state sensor 84 package by upper controller 80. In sequence step 90, pressure is vented from CSP 28 by opening a valve 66*a* in vent system 64. In sequence step 92, the choke and kill lines are closed. In sequence step 94, the wellhead 16 connector lock is pressurized to prevent accidental ejection of BOP stack 14 from wellhead 16. In sequence step 96, fluid flowing up from the well is diverted, e.g., partially diverted, to the open vents to prevent erosion of CSP elements such as the slips 48, 60. For example, fluid flow may be diverted by operating a deflection device 70 to a closed position. In sequence step 98, tubular 38 is secured in lower CSP 34 by closing lower slips 60. In sequence step 100, tubular 38 is secured in upper CSP 32 by closing upper slips 48. In sequence step 102, tubular 38 is sheared in lower CSP 34 by activating high energy shear 58. In sequence step 104, upper CSP 32 and lower CSP 34 are disconnected from one another by operating CSP connector 72 to a disconnected position, see, e.g., FIG. 3. In sequence step 106, riser 30 and upper CSP 32 are separated (e.g., ejected) from lower CSP 34 and BOP stack 14 by activating ejector device 74 (i.e., ejector bollards), see, e.g., FIG. 3. In sequence step 108, blind rams 56 are closed to shut-off fluid flow from BOP stack 14 through bore 40 and escaping to the environment. In sequence step 110, treating hydrate formation in lower CSP 34 by injecting methanol. In sequence step 112, closing the vents 66*a* opened in vent system 64 in sequence step 90. In sequence step 114, a formation stability test is performed.

Sequence step 102 according to one or more embodiments of subsea well safing system 10 is now described. After tubular 38 is engaged and secured respectively in upper CSP 32 (i.e., by slips 48) and lower CSP 34 (i.e., slips 60), lower controller 82 actuates high energy shear 58 thereby shearing tubular 38 between upper slips 48 and lower slips 60. According to one or more embodiments, high energy shear 58 can apply a force of 12 million pounds-force or more.

Figure 5:
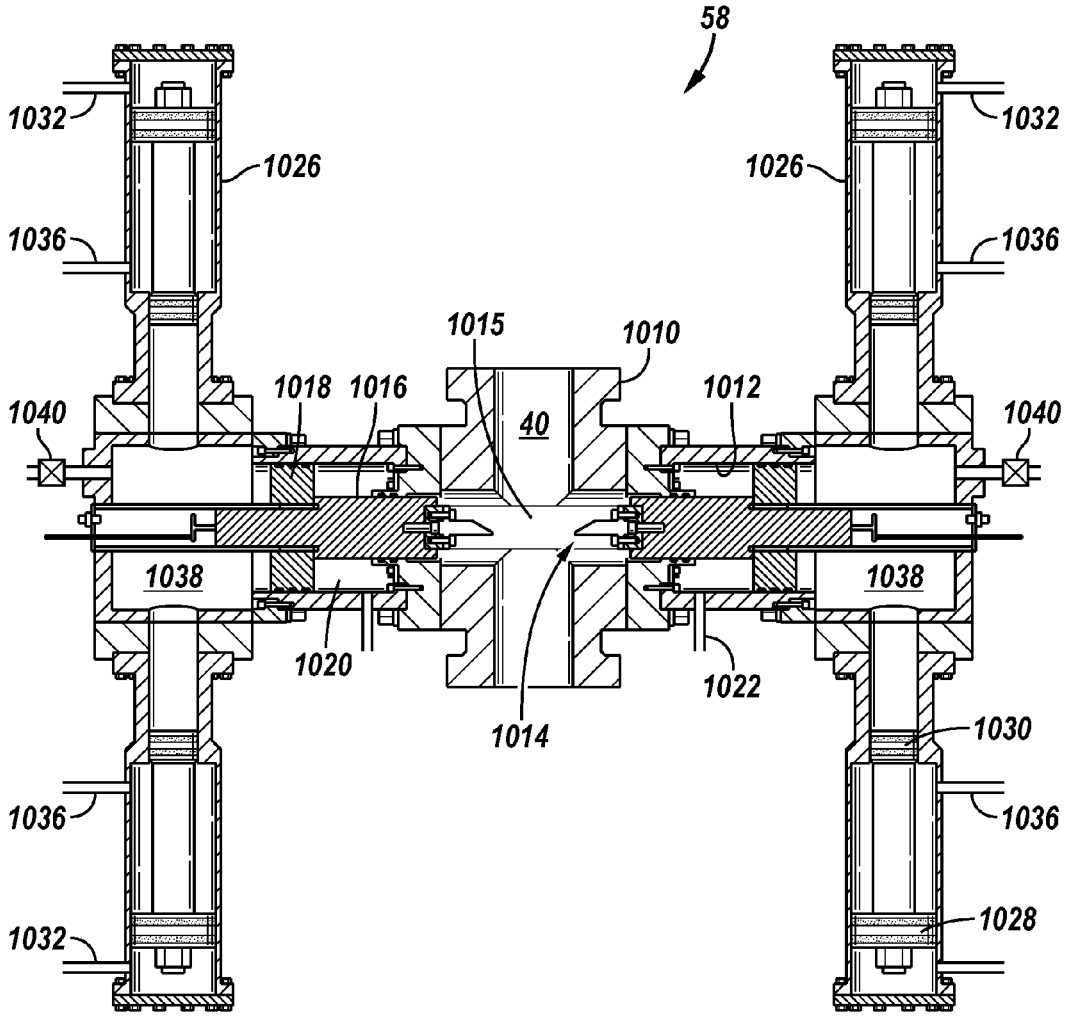
FIG. 5 illustrates a high energy tubular shear in a retracted position in accordance to one or more embodiments.
Figure 6:
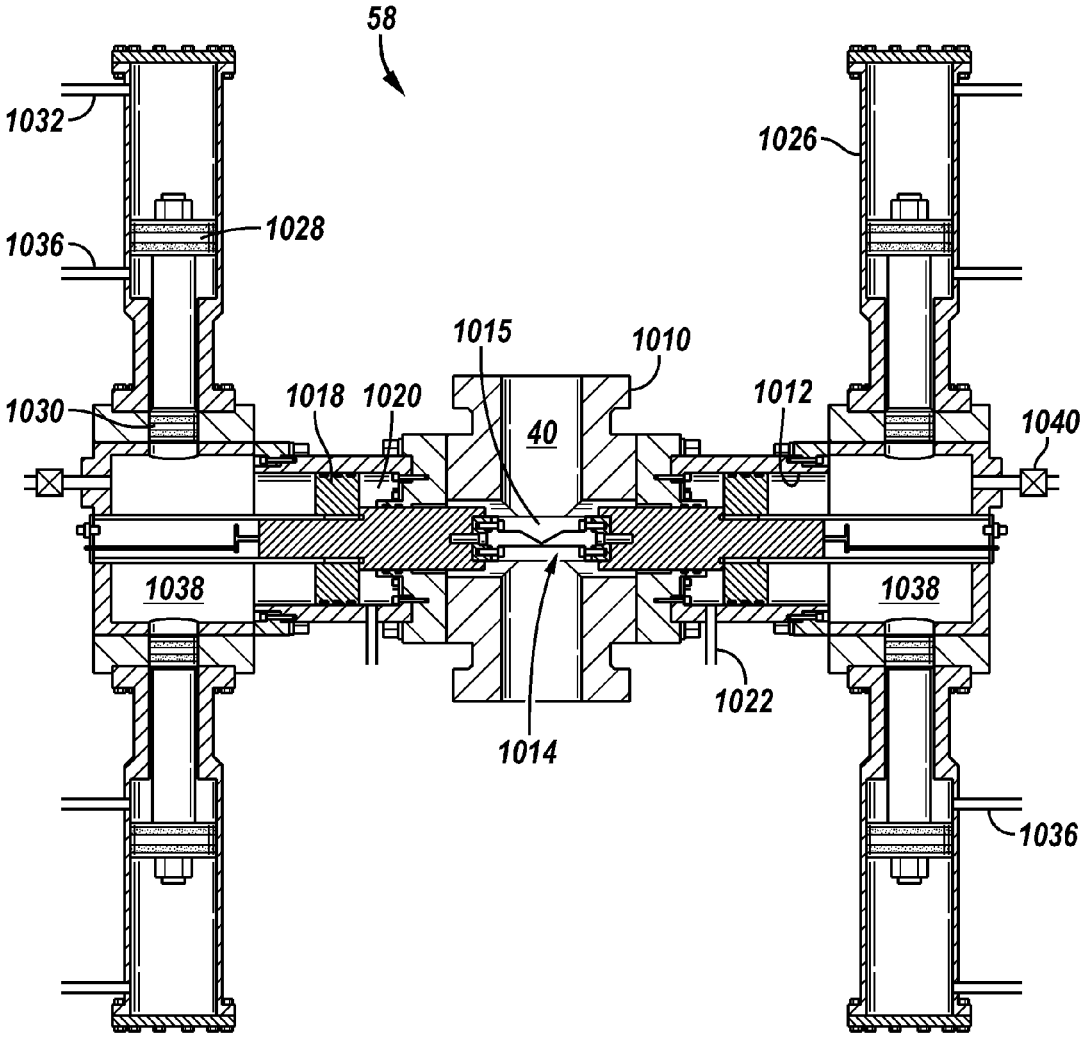
FIG. 6 illustrated the high energy tubular shear in an extended position in accordance to one or more embodiments.
Figure 8:
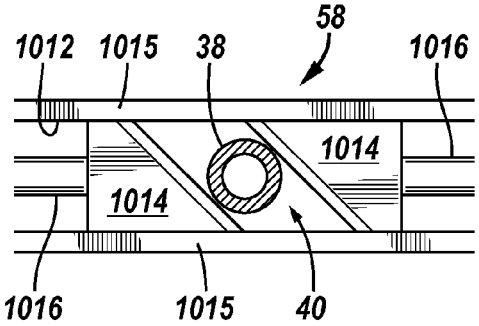
FIG. 8 is a schematic illustration of a pipe disposed between opposing cutters and backing plates of a high energy tubular shear in accordance to one or more embodiments.
Figure 7:
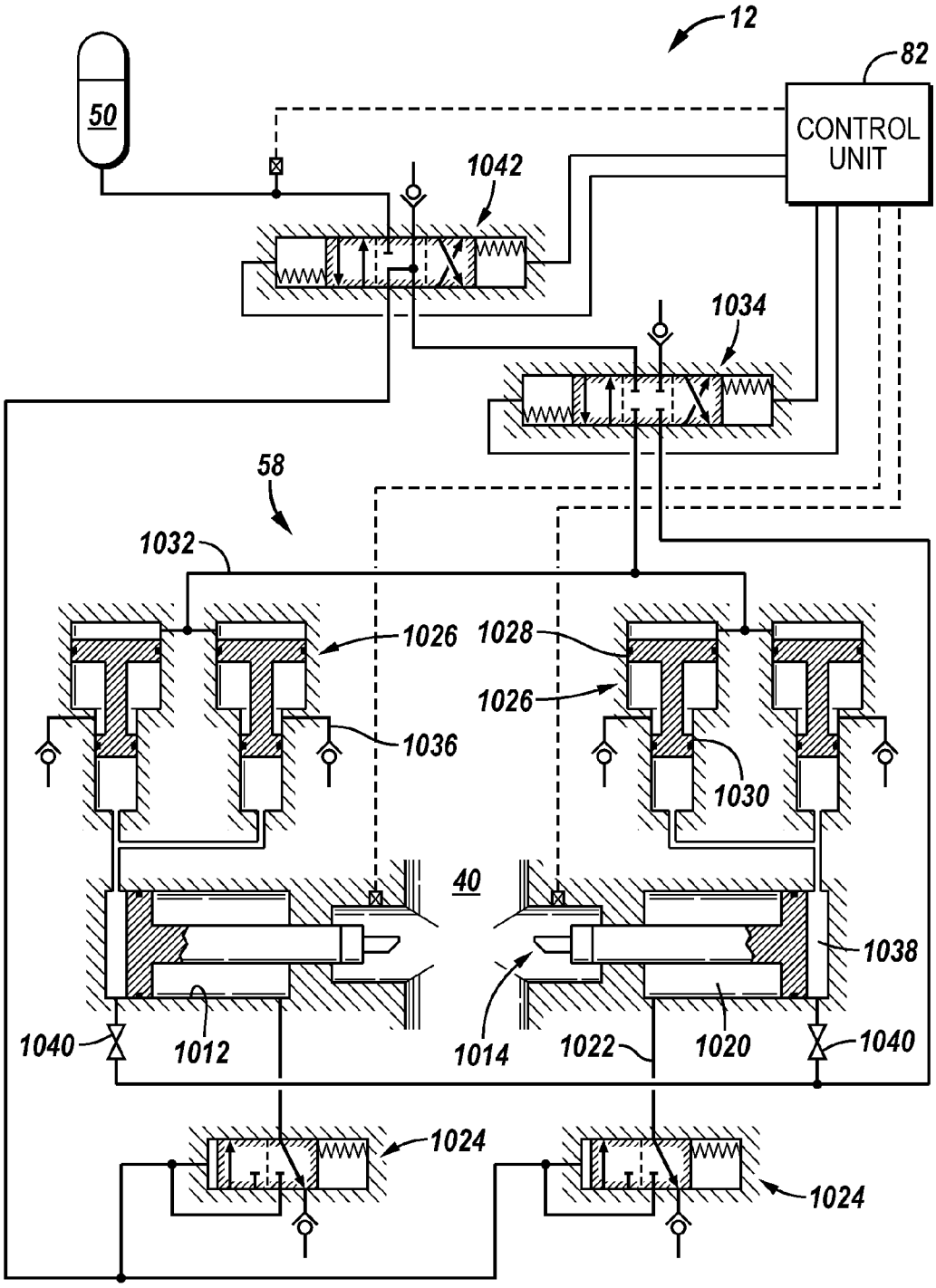
FIG. 7 is a schematic diagram of a high energy tubular shear system in accordance to one or more embodiments.

FIGS. 5 and 6 illustrate a high energy shear 58 in accordance to one or more embodiments in isolation. FIG. 7 is a schematic diagram of a hydraulic circuit of a high energy shear 58 utilized in a well system 12. FIG. 8 illustrates a tubular 38 in the process of being severed by high energy shear 58. High energy shear 58 and an example of operation are now described with reference to FIGS. 1-8.

High energy shear 58 includes a body 1010 forming a bore 40 through which a tubular 38 FIGS. 1-3) is disposed for example during wellbore drilling, completion, and testing. A cross-bore 1012 intersecting bore 40 is formed through body 1010. Cutters 1014 (e.g., blades) are moveably positioned in the opposing branches of cross-bore 1012 such that cutters 1014 are opposing one another on opposite sides of bore 40. For example, a left cutter 1014 is disposed in the left branch or side of cross-bore 1012 and right cutter 1014 is disposed in the right branch or side of cross-bore 1012.

Cutters 1014 can be positioned between opposing backing plates 1015 (see, e.g., FIG. 8) to take the cutting force (e.g., 12 million pounds) generated when cutting a tubular 38 with high energy shear 58. For example, with reference in particular to FIG. 8, opposing backing plates 1015 are spaced laterally apart and are positioned in cross-bore 1012 and extend across bore 40. According to some embodiments, cutters 1014 extend laterally the width between opposing backing plates 1015.

Each cutter 1014 is mounted on a ram 1016 (i.e., rod) carrying a piston 1018. Piston 1018 is spaced a distance away from cutter 1014 such that a retraction chamber 1020 is formed in cross-bore 1012. Each retraction chamber 1020 is in selective hydraulic communication through a respective fill port 1022 with a hydraulic system represented by hydraulic accumulator 50. With reference to FIG. 7, hydraulic communication is provided through a retraction valve 1024 and power valve 1042 to retract cutters 1014 from the extended or shearing position depicted in FIG. 6 and to the retracted position of FIG. 5.

Each side of cross-bore 1012 is in hydraulic communication with a respective hydraulic intensifier 1026. In the depicted embodiment, two hydraulic intensifiers 1026 are in hydraulic communication with each side of cross-bore 1012. As will be understood by those skilled in the art with benefit of this disclosure, only one or both intensifiers 1026 of a respective pair of intensifiers may be actuated to motivate the respective cutter 1014. Hydraulic intensifier 1026 has a low pressure piston 1028 and a high pressure piston 1030. Low pressure piston 1028 is in fluid communication with hydraulic source 50 via shear line 1032 and shear control valve 1034. A relief line 1036 is in hydraulic communication with intensifier 1026 between pistons 1028, 1030 to relieve back pressure.

A chamber 1038, also referred to as a dual mode chamber 1038, is located on the opposite side of cutter piston 1018 from retraction chamber 1020 and between cutter piston 1018 and high pressure piston 1030 of the respective intensifier 1026. Dual mode chamber 1038 is in hydraulic communication with system hydraulic pressure (e.g., hydraulic accumulator 50) through a valve 1040. Valve 1040 is closed, isolating dual mode chamber 1038 from the system hydraulic pressure during shear operations. Valve 1040 is open during fill operations and when cutters 1014 are being retracted and hydraulic fluid and pressure is being applied to retraction chamber 1020. According to embodiments, valve 1040 may have a remote operated vehicle interface to operate valve 1040 manually from ROV 124 (FIG. 2).

In operation, system hydraulic pressure and fluid volume may be applied and supplied for example from hydraulic accumulator 50 through valve 1040 into dual mode chamber 1038 to fill the chamber 1038 and extend cutters 1014 from the retracted position (FIG. 5) into contact (FIG. 8) with tubular 38. Valve 1040 can then be closed and dual mode chamber is changed to cutting pressure. Application of hydraulic pressure via intensifiers 1026 urges opposing cutters 1014 to the fully extended position as shown for example in FIG. 6. In the instance that the portion of tubular 38 that is positioned between the cutters is a thick pipe or a tool joint the cutters 1014 first act to nick and weaken tubular 38 and the continued movement of cutters 1014 toward one another then crushes and severs tubular 38. Upon cutting of tubular 38, cutters 1014 come into contact with one another as illustrated for example in FIG. 6.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A subsea well system, comprising:

a safing assembly connector interconnecting a lower safing assembly to an upper safing assembly, the lower safing assembly connected to a blowout preventer stack on a subsea well and the upper safing assembly connected to a marine riser;

the lower safing assembly comprising lower slips to engage a tubular suspended in a bore formed through the lower and the upper safing assemblies;

the upper safing assembly comprising upper slips operable to engage the tubular; and a tubular shear positioned between the upper slips and the lower slips, the tubular shear comprising:

a body forming the bore through which the tubular is disposed and a cross-bore intersecting the bore;

opposing cutters moveably positioned in the cross-bore on opposite sides of the bore;

laterally spaced apart opposing backing plates located in the cross-bore and extending across the bore, wherein the opposing cutters are positioned between the opposing backing plates; and the each cutter in hydraulic communication with a respective hydraulic intensifier.

2. The system of claim 1, wherein the each cutter is in hydraulic communication with a respective two hydraulic intensifiers.

3. The system of claim 1, comprising:

the each cutter disposed on a ram having a piston; and a retraction chamber is formed in the body between the piston and the cutter.

4. The system of claim 1, further comprising:

the each cutter disposed on a ram having a piston;

a retraction chamber formed in the body between the piston and the cutter; and a chamber disposed between the intensifier and the piston of the respective cutter.

5. The system of claim 4, wherein the each cutter is in hydraulic communication with a respective two hydraulic intensifiers.

6. A tubular shear connectable within a drilling system, comprising:

a body forming a bore through which a tubular is disposed and a cross-bore intersecting the bore;

laterally spaced apart backing plates located in the cross-bore and extending across the bore;

opposing cutters moveably positioned in the cross-bore on opposite sides of the bore, wherein the opposing cutters are positioned between the opposing backing plates; and the each cutter in hydraulic communication with a respective hydraulic intensifier.

7. The device of claim 6, wherein the each cutter is in hydraulic communication with a respective two hydraulic intensifiers.

8. The device of claim 6, comprising:

the each cutter disposed on a ram having a piston; and a retraction chamber is formed in the body between the piston and the cutter.

9. The device of claim 6, further comprising:

the each cutter disposed on a ram having a piston;

a retraction chamber formed in the body between the piston and the cutter; and a chamber disposed between the intensifier and the piston of the respective cutter.

10. The device of claim 9, wherein the each cutter is in hydraulic communication with a respective two hydraulic intensifiers.

11. The device of claim 9, further comprising:

the each cutter disposed on a ram having a piston;

a retraction chamber formed in the body between the piston and the cutter; and a chamber disposed between the intensifier and the piston of the respective cutter.

12. A subsea well safing sequence, comprising:

utilizing a safing assembly installed between a blowout preventer stack of a subsea well and a marine riser, the safing assembly comprising a lower safing assembly connected to the blowout preventer stack and an upper safing assembly connected to the marine riser forming a bore between the riser and the blowout preventer stack;

securing a tubular suspended in the bore at a position in the lower safing assembly;

securing the tubular at a position in the upper safing assembly;

utilizing a shear having a tubular extending through a bore into a wellbore, the shear comprising:

a body forming the bore through which the tubular is disposed and a cross-bore intersecting the bore;

opposing cutters moveably positioned in the cross-bore on opposite sides of the bore;

laterally spaced apart opposing backing plates located in the cross-bore and extending across the bore, wherein the opposing cutters are positioned between the opposing backing plates; and the each cutter in hydraulic communication with a respective hydraulic intensifier;

applying a hydraulic pressure to the respective hydraulic intensifiers;

moving the cutters toward each other in response to the application of hydraulic pressure to the respective hydraulic intensifiers; and shearing the tubular in response to moving the cutters toward each other.

13. The method of claim 12, wherein the shear further comprises:

the each cutter disposed on a ram having a piston;

a retraction chamber formed in the body between the piston and the cutter; and a dual-mode chamber disposed between the hydraulic intensifier and the piston of the respective cutter.

14. The method of claim 12, further comprising moving the cutters from a retracted position into contact with the tubular before applying the hydraulic pressure to the respective hydraulic intensifiers.

15. The method of claim 14, wherein the shear further comprises:

the each cutter disposed on a ram having a piston;

a retraction chamber formed in the body between the piston and the cutter; and a dual-mode chamber disposed between the hydraulic intensifier and the piston of the respective cutter.

16. The method of claim 12, wherein the securing the tubular in the bore comprises securing and engaging the tubular with slips; and the securing the tubular in the upper safing assembly comprises securing and engaging with the slips.

17. The method of claim 16, further comprising moving the cutters from a retracted position into contact with the tubular before applying the hydraulic pressure to the respective hydraulic intensifiers.

18. The method of claim 16, wherein the shear further comprises:

the each cutter disposed on a ram having a piston;

a retraction chamber formed in the body between the piston and the cutter; and a dual-mode chamber disposed between the hydraulic intensifier and the piston of the respective cutter.

19. The method of claim 18, further comprising moving the cutters from a retracted position into contact with the tubular before applying the hydraulic pressure to the respective hydraulic intensifiers.

* * * * *